US005142334A

United States Patent [19]

Iemura et al.

[11] Patent Number: 5,142,334

[45] Date of Patent: Aug. 25, 1992

[54] LIQUID DEVELOPING DEVICE AND STORAGE UNIT FOR USE THEREIN

[75] Inventors: Shigeru Iemura, Kawasaki; Kazuhiro Shimamura, Tokyo, both of Japan

[73] Assignee: Matsushita Graphic Communication Systems, Inc., Tokyo, Japan

[21] Appl. No.: 576,586

[22] Filed: Sep. 4, 1990

[30] Foreign Application Priority Data

Sep. 4, 1989 [JP] Japan ..... 1-228558

[51] Int. Cl.[5] ..... G03G 15/10

[52] U.S. Cl. ..... 355/256; 118/644

[58] Field of Search ..... 355/256, 260; 118/644; 354/324; 222/DIG. 1

[56] References Cited

U.S. PATENT DOCUMENTS 4,222,497 9/1980 Lloyd et al. ..... 118/689
4,629,303 12/1986 Vermarien ..... 354/320
4,634,252 1/1987 Jeremijevic ..... 354/324

*Primary Examiner*—A. T. Grimley
*Assistant Examiner*—Christopher Horgan
*Attorney, Agent, or Firm*—Lowe, Price, LeBlanc & Becker

[57] ABSTRACT

In a developing device for electrostatic recording using a liquid developer, a first connector member firmly receives one end of a developer supply pipe and one end of a developer retrieval pipe, and a second connector member is firmly fitted in an opening of a developer storage tank for closing the same and firmly receives one end of pipes which open at opposite end to the inside of the developer storage tank. The developer storage tank is movable in a direction to fit the first and second connector members closely together under pressure for interconnecting the pipes retained by the first connector member and the corresponding pipes retained by the second connector member. With this construction, the developer storage tank can be replaced with utmost ease.

9 Claims, 4 Drawing Sheets

LIQUID DEVELOPING DEVICE AND STORAGE UNIT FOR USE THEREIN

BACKGROUND OF THE INVENTION

1. Field of the Invention

The present invention relates generally to a liquid developing device using a liquid developer and a concentrating agent, and more particularly to a storage unit for storing the liquid developer and the concentrating agent.

2. Description of the Related Art

With an accelerated development of copying machines and plotters in recent years, there has been an increased demand for a compact liquid developing device for used in these apparatus.

In a liquid developing device of the type concerned, the concentration of a liquid developer is gradually reduced with the consumption of a developer component (toner particles). A system is, therefore, provided for automatically detecting the toner concentration of the liquid developer to control the amount of a concentrating agent to be added to the liquid developer at need. The detection of the toner concentration relies upon an optical means or a measurement of the electric characteristics of the liquid developer. In this known system, when the concentrating agent is to be added, the concentrating agent is drawn from a storage tank which is provided separately from the liquid developer storage tank, and then it is introduced into a circulating path of the liquid developer. This means that the concentrating agent storage tank and a portion of the circulating path of the liquid developer are connected by a separate passage. In some cases, the separate passage includes an additional chamber. One such known developing device is disclosed by U.S. Pat. No. 4,222,497. The disclosed developing device is large in size because the liquid developer storage tank and the concentrating agent storage tank are disposed separately. Furthermore, due to this disposition of two independent storage tanks, these tanks are likely to be misplaced with each other when they are replaced.

One solution to the foregoing difficulties is proposed by U.S. Pat. No. 4,634,252 wherein a storage tank includes a first storage chamber for containing a liquid developer and a second storage chamber for containing a concentrating agent and operatively connected with the first storage chamber for directly replenishing the concentrating agent from the second chamber to the first chamber. With the storage tank thus constructed, the developing device is relatively small and free from the problem of misplacement of the development storage tank and the concentrating agent storage tank. However, since pipes which form part of respective circulating paths of the liquid developer and the concentrating agent extend close to the bottom of the storage tank, the liquid developer and the concentrating agent existing on or within the pipes are liable to fall onto the floor either directly or through the storage tank when the storage tank is removed, whereby the floor and operator's hands and clothes are smeared by the liquid developer and the concentrating agent. The storage chambers of the tank have flat bottom walls with the result that the amount of unused concentrating agent is relatively large.

SUMMARY OF THE INVENTION

With the foregoing difficulties in view, it is an object of the present invention to provide a liquid developing device including a storage unit or tank which contains a liquid developer and a concentrating agent separately and can be replaced with utmost ease.

Another object of the present invention is to provide a liquid developing device incorporating structural features which prevent a floor surface and operator's hands and clothes from being smeared by drops of a liquid developer or a concentrating agent when a storage tank is replaced.

A further object of the present invention is to provide a liquid developing device which enables a considerable reduction of the amount of unused concentrating agent remaining in a storage tank.

A first aspect of the present invention provides a liquid developing device for electrostatic recording using a liquid developer, comprising: a first connector member firmly receiving one end of a first supply pipe for supplying a liquid developer to a developing unit, and one end of a first retrieval pipe for returning the liquid developer from the developing unit; a storage tank for containing the liquid developer; a second connector member firmly fitted in an opening of the storage tank for closing the same and firmly receiving one end of a second supply pipe and one end of a second retrieval pipe which correspond to the first supply pipe and the first retrieval pipe, respectively; and means for moving the storage tank in a direction to bring the first connector member and the second connector member into pressure contact with each other so as to fluid-tightly connect together the first and second supply pipes and the first and second retrieval pipes.

A second aspect of the present invention provides a liquid developing device for electrostatic recording using a liquid developer, comprising: a first connector member firmly receiving one end of a first supply pipe for supplying a liquid developer to a developing unit, one end of a first retrieval pipe for returning the liquid developer from the developing unit, and one end of a first replenisher pipe for replenishing a concentrating agent; a first storage tank for containing the liquid developer; a second storage tank for containing the concentrating agent; a second connector member firmly fitted in an opening of the first storage tank for closing the same and firmly receiving one end of a second supply pipe and one end of a second retrieval pipe which correspond to the first supply pipe and the first retrieval pipe, respectively; a third connector member firmly fitted in an opening of the second storage tank for closing the same and firmly receiving one end of a second replenisher pipe which corresponds to the first replenisher pipe; and means for moving the first and second storage tanks in a direction to bring the first connector member and the second connector member and the first connector member and the third connector member, respectively, into pressure contact with each other so as to fluid-tightly connect together the first and second supply pipes, the first and second retrieval pipes, and the first and second replenisher pipes. The first storage tank and the second storage tank may be integrally formed into a single storage tank.

A third aspect of the present invention provides a storage tank for containing therein a liquid developer or a concentrating agent, comprising: a storage chamber for containing the liquid developer or the concentrating agent; a closure member firmly fitted in an opening of the storage chamber for closing the same; and at least one pipe firmly received in the closure member, the pipe having one end opening to the outside of the storage chamber at a predetermined surface of the closure member, and an opposite end opening to the inside of the storage chamber.

A fourth aspect of the present invention provides a storage tank for containing a liquid developer and a concentrating agent, comprising: a first storage chamber for containing the liquid developer; a second storage chamber for containing the concentrating agent; and the first and second storage chambers being defined integrally with each other, the second storage chamber being tapered downwardly and having a varying cross-sectional area progressively reducing in a direction from the top toward the bottom of the second storage chamber. The second storage chamber receives therein a replenisher pipe for replenishing the concentrating agent, the replenisher pipe having an end opening to the inside of the second storage chamber and located close to the bottom of the second storage chamber.

The above and other objects, features and advantages of the present invention will become more apparent from the following description when making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
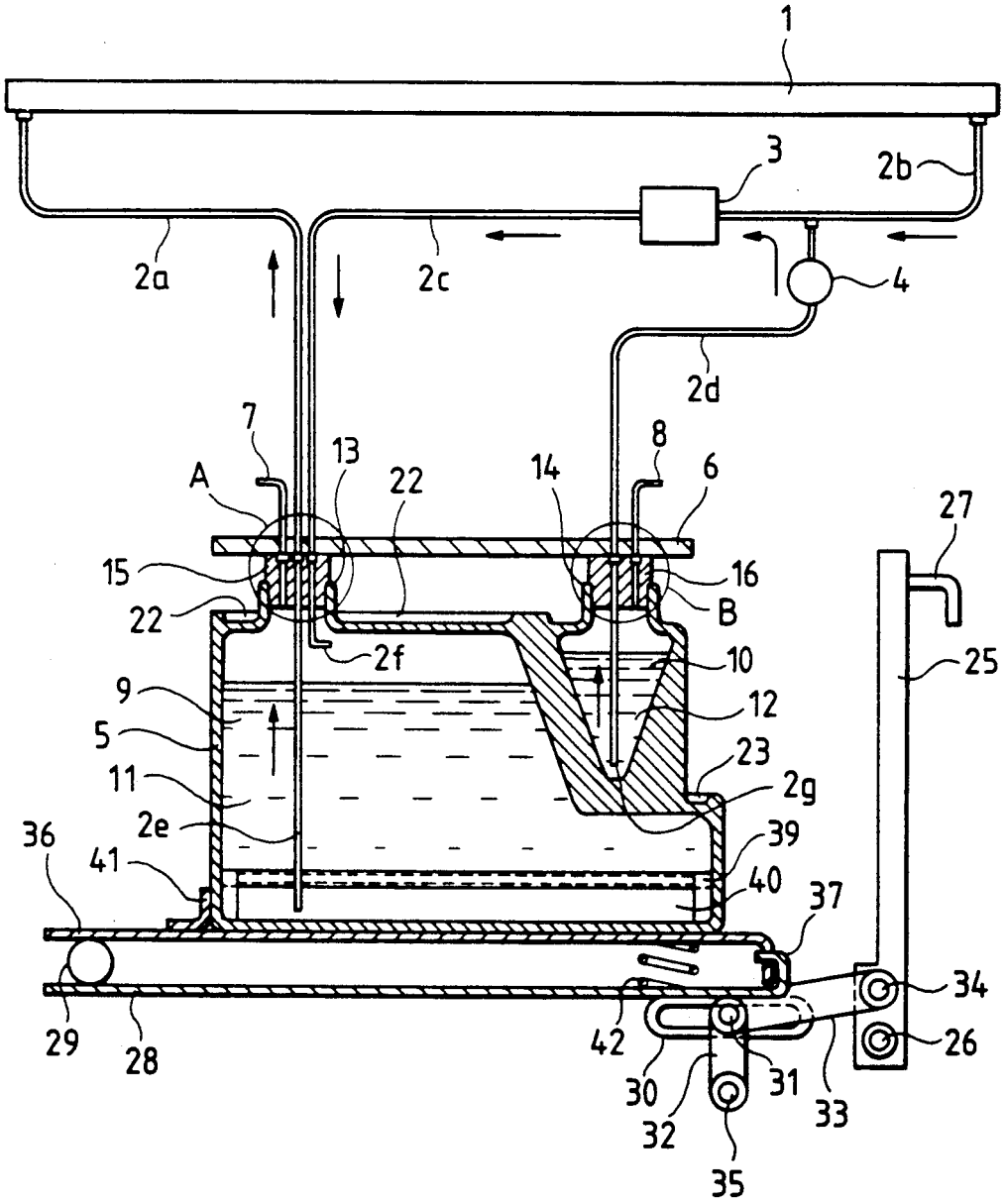
FIG. 1 is a diagrammatical view, partly in cross section, of a liquid developing device according to the present invention.

Referring now to the drawings wherein like reference characters designate like or corresponding parts throughout the several views, FIG. 1 diagrammatically shows a liquid developing device according to the present invention.

The liquid developing device includes a flat elongate developing unit 1 (developing station) by means of which a latent image on a recording medium such as recording paper is developed as the recording medium slides along an upper surface of the developing unit 1. A supply pipe 2*a*, retrieval pipes 2*b*, 2*c* and a pump 3 are provided for circulating (namely, supplying and retrieving) a liquid developer through the developing unit 1. A replenisher pipe 2*d* and a solenoid-controlled valve 4 are provided for replenishing a concentrating agent to maintain the concentration of the liquid developer at a constant level.

The supply pipe 2*a* is connected at its one end to an inlet or suction side of the developing unit 1. The retrieval pipe 2*b* is connected at its one end to an outlet or delivery side of the developing unit 1. The opposite end of the retrieval pipe 2*b* is connected to an inlet or suction side of the pump 3. An outlet or delivery side of the pump 3 is connected to one end of the retrieval pipe 2*c*. The replenisher pipe 2*d* is connected via the solenoid-controlled valve 4 to an intermediate portion of the retrieval pipe 2*b*.

Figure 2:
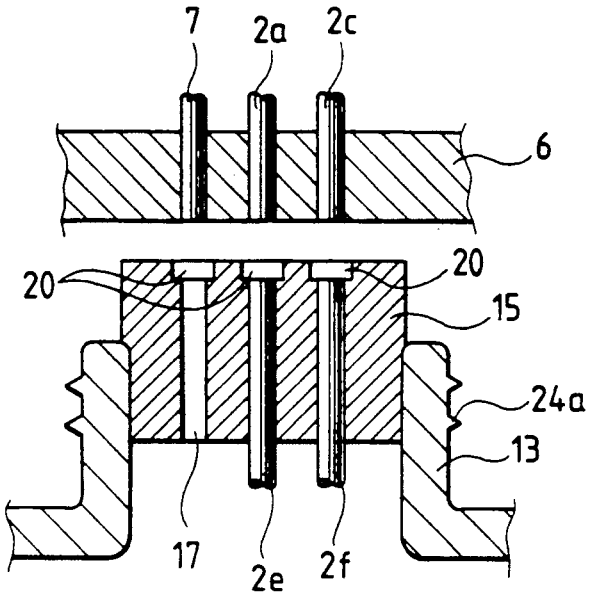
FIG. 2 is an enlarged cross-sectional view of a portion indicated by a circle A of FIG. 1.
Figure 3:
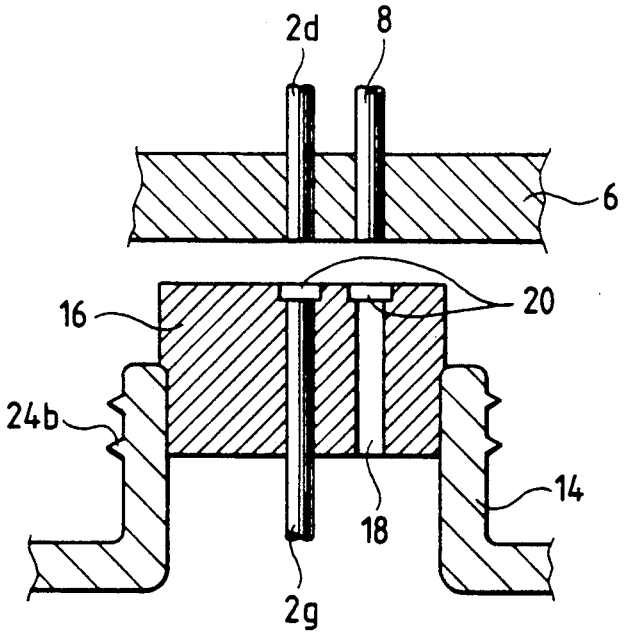
FIG. 3 is an enlarged cross-sectional view of a portion indicated by a circle B of FIG. 1.

The opposite ends of the respective pipes 2*a*, 2*c*, 2*d* are adapted to be connected to corresponding pipes, described later, on a storage unit or tank 5 and they are firmly received in a substantially horizontal connector plate 6. Two air pipes 7, 8 are firmly received in the connector plate 6. The air pipe 7 is disposed adjacent to the pipes 2*a*, 2*c*, while the air pipe 8 is disposed adjacent to the pipe 2*d*. The connector plate 6 is formed of a sheet metal, for example, secured to a body of the liquid developing device. As shown in FIGS. 2 and 3, the pipes 2*a*, 2*c*, 2*d* and the air pipes 7, 8 are fixed in the connector plate 6 with their ends opening to and lying flush with a lower surface of the connector plate 6.

The storage tank 5 is of the integral structure molded of synthetic resin, for example, and has two internal storage chambers 9, 10 provided for containing a liquid developer 11 and a concentrating agent 12, respectively. The concentrating agent storage chamber 10 is tapered downwardly so that the cross-sectional area of this storage chamber 12 progressively reduces in a direction from the top toward the bottom of the storage chamber 12. With this tapered storage chamber 10, the amount of unused concentrating agent can be reduced considerably.

The storage chambers 9, 10 have openings 13, 14 at their uppere ends, and connector plugs 15, 16 are firmly fitted in the respective openings 13, 14. The connector plug 15 firmly receives upper ends of two pipes 2*e*, 2*f* which are adapted to be connected with the supply pipe 2*a* and the retrieval pipe 2*c*, respectively. The connector plug 15 further has a vent hole 17 adapted to be connected with the air pipe 7. The pipe 2*e* is provided to draw up the liquid developer 11 from the storage chamber 9 and has its lower end positioned close to the bottom of the storage chamber 9. The pipe 2*f* is provided to return the liquid developer 11 into the storage chamber 9 and has its lower end disposed adjacent to the top wall of the storage chamber 9. Likewise, the connector plug 16 firmly receives an upper end of a pipe 2*g* which is adapted to be connected with the replenisher pipe 2*d*. The connector plug 16 further has a vent hole 18 adapted to be connected with the air pipe 8. The pipe 2*g* is provided to draw up the concentrating agent from the storage chamber 12 and has its lower end located close to the bottom of the storage chamber 12.

Each of the connector plug 15, 16 serves as a closure plug for closing the corresponding opening 13, 14 and also as a connector member for fluid-tightly connecting the pipe 2*e*, 2*f* and the vent hole 17 (or the pipe 2*g* and the vent hole 18) with the corresponding pipes 2*a*, 2*c* and the air pipe 7 (or the corresponding pipe 2*d* and the air pipe 8) by being closely fitted to the connector plate 6 at a constant pressure. To perform both functions stably and reliably, the connector plugs 15, 16 are made of an elastic material such as rubber having an appropriate degree of elasticity. To enhance the reliability of the connecting operation, the connector plugs 15, 16 have shallow holes 20 formed in their upper surfaces at positions corresponding to the positions of the respective pipes 2*a*, 2*c*, 2*d*, 7, 8, the holes 20 having a diameter slightly larger than the diameter of the pipes 2*a*, 2*c*, 2*d*, 7, 8. The upper ends of the pipes 2*e*, 2*f*, 2*g* are retracted downwardly from the upper surfaces of the connector plugs 15, 16 until they lie flush with the bottom of the corresponding shallow holes 20. The vent hole 17, 18 communicate with the corresponding hallow holes 20.

As shown in FIGS. 2 and 3, each of the openings 13, 14 is a hollow cylindrical shape and has on its outer peripheral wall a screw thread 24*a*, 24*b* for retaining a cap, described later. The storage tank 5 also has in its upper surface two recessed portions 22, 23 opening upwardly for receiving the liquid developer and the concentrating agent which may dorps from the pipes 2*a*, 2*c*, 2*d* when the storage tank 5 is replaced. In practice, the occurance of such drops can be substantially eliminated, as described later.

FIGS. 2 and 3 illustrate the connector plugs 15, 16 as they are separated from the connector plate 6 for purposes of illustration and clarity, however, they are closely fitted together when the storage tank 5 is disposed in the operating position shown in FIG. 1.

Operation of the liquid developing device will be described below. For purposes of illustration, operation begins with parts held in the condition shown in FIG. 1. In this instance, the upper surfaces of the respective connector plugs 15, 16 are forced against the lower surface of the connector plate 6 at a constant pressure so that the upper surfaces of the plugs 15, 16 and the lower surface the connector plate 6 are closely fitted together. With this pressure contact between the connector plugs 15, 16 and the connector plate 6, the pipes 2*a*, 2*c*, 2*d* and the air pipes 7, 8 on the developing unit side are fluid-tightly connected with the corresponding pipes 2*e*, 2*f*, 2*g* and the vent holes 17, 18 on the storage tank side.

In this condition, the pump 3 is driven whereupon a negative pressure is created in the pipe 2*b*. The negative pressure then acts in a space between a developer passage (not shown) and a recording paper with the result that the liquid developer 11 in the storage chamber 9 is drawn through the pipes 2*e* and the pipe 2*a* into the developing unit 1. The liquid developer 11 as it flows through the passage formed in the developing unit 1 is brought into contact with a latent image on the recording paper, thereby developing the latent image. An excess amount of liquid developer 11 flows toward the delivery side of the developing unit 1 and is retrieved successively through the pipe 2*b*, pump 3, pipe 2*c* and pipe 2*f* into the storage chamber 9.

The air pipe 7 and the vent hole 17 cooperate to maintain the inside of the storage chamber 9 substantially at the atmospheric pressure.

As the liquid developer 11 is consumed while being circulated through the developing unit 1, the concentration of the liquid developer 11 in the storage chamber 9 reduces gradually. When the concentration of the liquid developer 11 is lowered to a predetermined level, this concentration level is detected by a sensor, not shown, whereupon a control circuit, not shown, activates the solenoid-controlled valve 4 to open the same for a predetermined period of time either continuously or intermittently. While the solenoid-controlled valve 4 is being open, the concentrating agent 12 in the storage chamber 10 is drawn through the pipes 2*g*, 2*d* by the suction of the pump 3 and then delivered successively through the pipe 2*b*, pump 3, pipe 2*c* and pipe 2*f* to the storage tank 9. Thus, the concentration of the liquid developer 11 in the storage chamber 9 is maintained above a predetermined level.

The concentration of the liquid developer 11 is detected by the density sensor (not shown) disposed in the path of circulation of the liquid developer 11. The density sensor may comprise a conventional means which is operative in response to the optical relationship between the concentration and the light transmission properties, or the electric relationship between the concentration and the electric conductivity. The air pipe 8 and the vent hole 18 cooperate to maintain the inside of the storage chamber 10 substantially at the atmospheric pressure.

During the developing operation, the concentrating agent 12 in the storage chamber 10 reduces progressively. However, since the storage chamber 10 is tapered downwardly and has a smaller cross-sectional area at its bottom than at its top wall, and since the lower end of the pipe 2*g* is located close to the bottom the storage chamber 10, the concentrating agent 12 in the storage chamber 10 can substantially fully be used.

A mechanism which enables the storage tank 5 to be attached and replaced relative to the body of the developing device will be described below with reference to FIGS. 1, 4 and 5 through 8.

Figure 4:
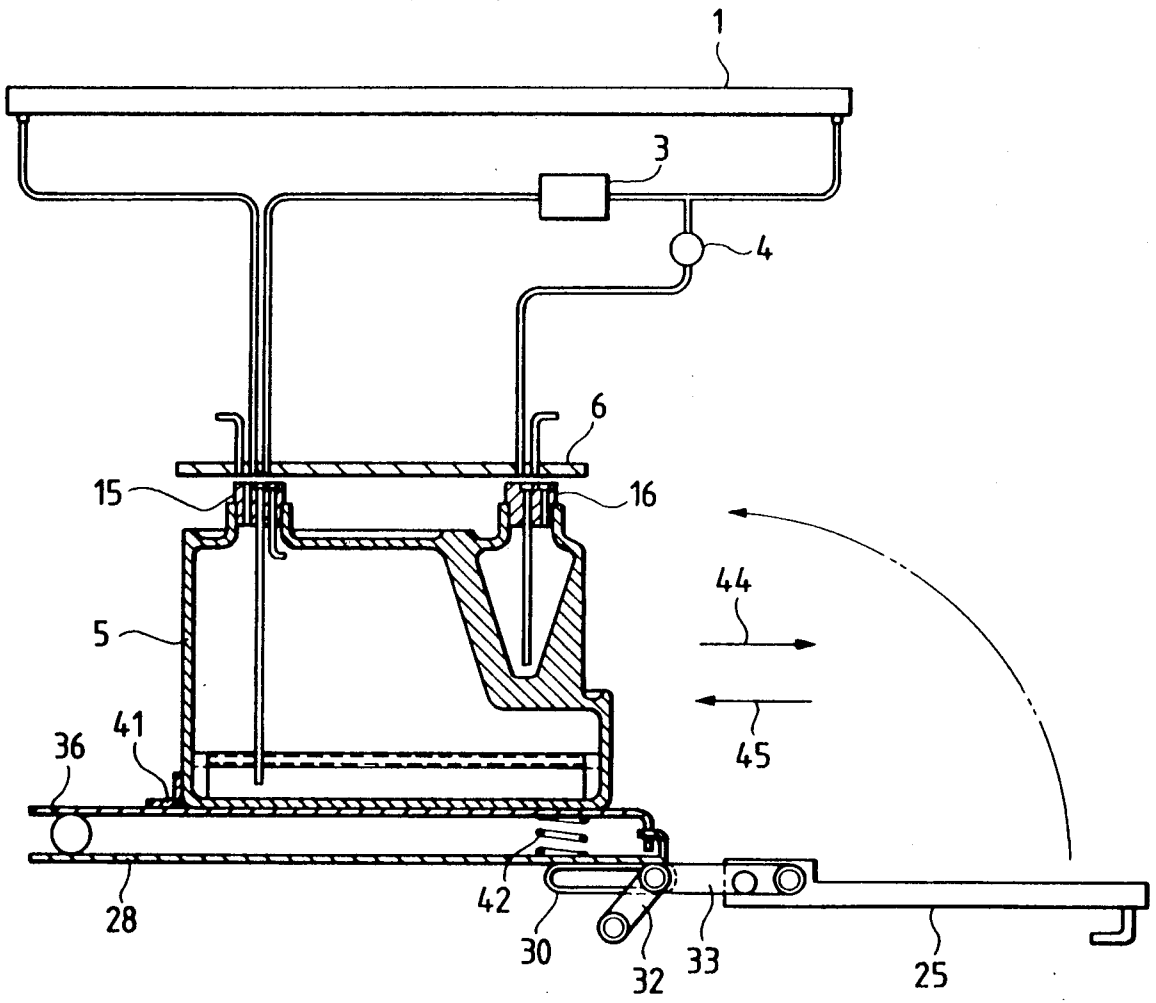
FIG. 4 is a view similar to FIG. 1, but showing the liquid developing device with a door disposed in an open position.
Figure 5:
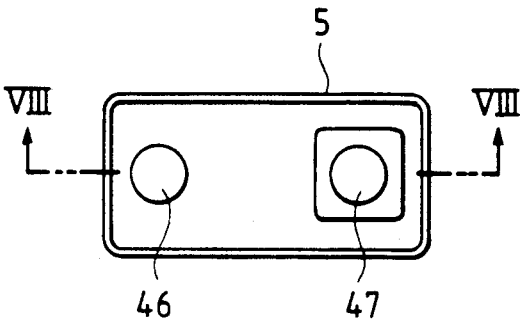
FIG. 5 is a schematic plan view of a storage unit or tank incorporated in the liquid developing device.
Figure 6:
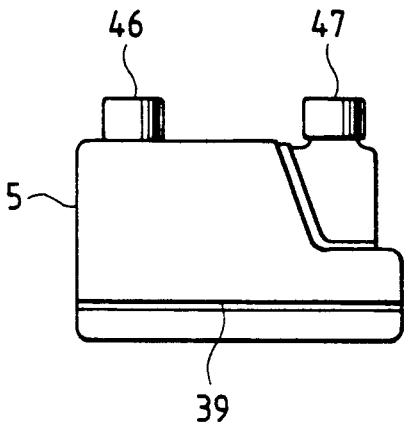
FIG. 6 is a schematic front elevational view of the storage tank.
Figure 7:
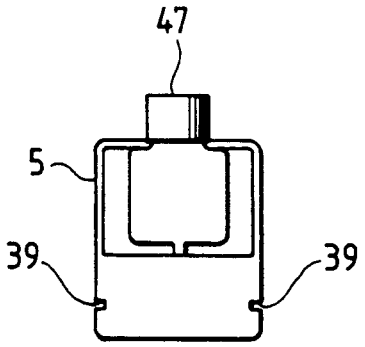
FIG. 7 is a schematic side view of the storage tank.
Figure 8:
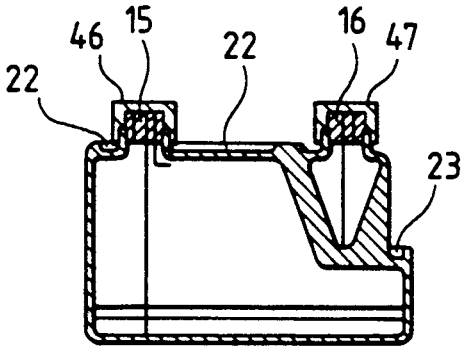
FIG. 8 is a cross-sectional view taken along line VIII—VIII of FIG. 5.

The mechanism includes a door 25 adapted to be opened as shown in FIG. 4 when the storage tank 25 is to be replaced. The door 25 is pivoted at its lower end to the body of the developing device by means of a horizontal shaft 26. A handle 27 is provided on the door 25 adjacent to an upper end thereof. A substantially horizontal bottom plate 28 is pivotally connected at its rear end to the body of the developing device by means of a horizontal shaft 29. A slide rail 30 comprising a flat ring is secured to the front end of the bottom plate 28 and slidably receives a shaft 31 which is connected to one end of link plates 32, 33. The opposite end of the link plate 33 is pivoted by a shaft 34 to the door 25, while the opposite end of the link plate 32 is pivoted to the body of the developing device by a shaft 35.

A substantially horizontal support plate 36 is pivotally connected at its rear end to the shaft 29. The support plate 36 has a front end bent downwardly. The downwardly bent front end has a horizontal oblong hole 38 (FIG. 1) lockingly engageable with a hook-shaped locking prong 37 formed at the front end of the bottom plate 28. The support plate 36 further has a pair of guide projections 40 in the shape of guide rails of an inverted L shape slidably engageable with guide grooves 39 (FIG. 6) formed in opposite side walls of the storage tank 5, and a stopper 41 (FIG. 1) disposed adjacent to the rear end of the support plate 36. A compression coil spring 42 is disposed between the support plate 36 and the bottom plate 28 and acts between them to urge the front ends of the respective plates 36, 28 to spread outwardly away from each other.

When the storage tank 5 is to be replaced, the handle 27 while being gripped by the operator is pulled to turn the door 25 clockwise in FIG. 1 about the shaft 26 until the door 25 is disposed in a horizontal, fully opened position shown in FIG. 4. In response to the pivotal movement of the door 25, the link plates 32, 33 and the slide rail 30 co-act to turn the bottom plate 28 clockwise from the horizontal position by a predetermined angular distance. This angular movement of the bottom plate 28 is transmitted by the hook-shaped prong 37 to the support plate 36 to cause the support plate 36 to turn clockwise from the horizontal position by the predetermined angular distance against the force of the spring 42. Thus, the connector plugs 15, 16 and the connector plate 6 are separated from one another.

It likely occurs that the connector plugs 15, 16 and the connector plate 6 stick together as a result of a prolonged continuous use of the storage tank 5 and hence a relatively large force or muscle effort is needed to separate the connector plugs 15, 16 and the connector plate 6. However, since a rotational force tending to turn the bottom plate 28 and the support plate 36 is enhanced by the lever action of the door 25, the connector plugs 15, 16 and the connector plate 6 can be separated without difficulty, and opening and closing operation of the door 25 is performed smoothly.

Thereafter, the storage tank 5 is pulled in the direction of the arrow 44 shown in FIG. 4 while the front and rear faces of the storage tank 5 are being held by operator's hands, whereby the storage tank 5 is removed from the body of the developing device.

During that time, the liquid developer 11 or the concentrating agent 12 may drop mainly from the pipes 2*a*, 2*c* or from the pipe 2*d*. However, such drop is unlikely to occur as compared to the conventional developing device and if it were to occur, the amount of dropped liquid developer or concentrating agent would be considerably smaller than that of the conventional developing device. Furthermore, the drop of liquid developer or the drop of concentrating agent are received respectively in the recess 22 and the recess 23. Thus, the liquid developer and the concentrating agent are prevented from falling onto the floor surface on which a copying machine incorporating the developing device is disposed, or from flowing down along the front and rear surfaces of the storage tank 5. The storage tank 5 can, therefore, be removed from the body of the developing device without smearing the floor surface and operator's hands.

The storage tank removing operation is simple and can be performed quickly because it does not involve rotation of a clamp ring which is needed in the case of removal of the conventional storage tank. Omission of the clamp ring is contributive to the prevention of smearing of operator's hands by the liquid developer and the concentrating agent.

Subsequently, a new storage tank 5 is attached to the developing device. The new storage tank 5, as shown in FIGS. 5 through 8, has caps 46, 47 threaded over the screw threads 24*a*, 24*b* (FIGS. 2 and 3) on the outer peripheral walls of the respective outlets 15, 16 to close the openings 13, 14, so that the liquid developer and the concentrating agent are prevented from leaking out from the storage tank 5 during storage or transportation. After the cap 46, 47 are removed, the new storage tank 5 is placed on the support plate 36 with the guide grooves 39 disposed in alignment with the guide rails or projections 40. Thereafter, the new storage tank 5 is forced in the direction of the arrow 45 in FIG. 4 until it abuts against the stopper 41. During that time, the storage tank 5 slides smoothly because the guide grooves 39 are guided on and along the guide projections 40. The new storage tank 5 is thus disposed in a stand-by position shown in FIG. 4.

Thereafter, the door 25 is turned counterclockwise from the horizontal, fully opened position shown in FIG. 4 to the vertical, fully closed position shown in FIG. 1. During that time, the bottom plate 28 is lifted from the tilted position to the horizontal position through the co-action between the link plates 32, 33 and the slide rail 30. Since the bottom plate 26 and the support plate 36 are resiliently connected together by the compression coil spring 42, the upward movement of the bottom plate 26 causes the support plate 36 to move upwardly. As a result, the connector plugs 15, 16 are forced into fluid-tight pressure contact with the support plate 6 under the force of the compression coil spring 42 so that the pipes 2*a*, 2*c*, 2*d* and the air pipes 7, 8 are fluid-tightly connected with the pipes 2*e*, 2*f*, 2*g* and the vent holes 17, 18, respectively. The pressure or force at which the connector plugs 15, 16 are forced against the connector plate 6 is dependent on the resiliency of the spring 42.

Since a pipe connecting mechanism of the invention including the connector plate 6 and the connector plugs 15, 16 obviates the need for the clamp ring, described above, which is incorporated in the conventional developing device and is to be actuated each time the storage tank is attached and detached, the storage tank 5 can be attached easily and speedily. The storage tank 5 needs only a small space for attachment/detachment thereof as against the conventional storage tank which requires a relatively large attachment/detachment space due to the presence of the clamp ring.

According to the embodiment described above, a storage tank for a liquid developer and a storage tank for a concentrating agent are integrally formed into a single storage tank. The replacement of the single storage tank is easier than the replacement of two separate storage tanks and does not involve misplacement which may be caused when the two separate tanks are replaced. The present invention is not limited to the illustrated embodiment. It is still within the scope of the present invention that two storage tanks are provided independently for containing the liquid developer and the concentrating agent, respectively. In this instance, other structural details are the same as those of the embodiment described above, whereby those advantageous effects which are peculiar to the same structural details can also be attained.

Additionally, the liquid developing device of the invention may be modified such that the concentrating agent is supplied from its storage chamber directly into the storage chamber of the liquid developer, as disclosed in U.S. Pat. No. 4,634,252. In this instance, other structural features are maintained without modification so that those advantageous effects which are peculiar to the structural details are attainable.

It is also possible to modify the liquid development device such that the connector plate 6 is vertically movable toward and away from the connector plugs 15, 16.

Obviously various minor changes and modifications of the present invention are possible in the light of the above teaching. It is therefore to be understood that within the scope of the appended claims the invention may be practiced otherwise than as specifically described.

What is claimed is:

1. A liquid developing device for electrostatic recording using a liquid developer, comprising:

a first connector member firmly receiving one end of a first supply pipe for supplying a liquid developer to a developing unit, and one end of a first retrieval pipe for returning the liquid developer from the developing unit;

a storage tank for containing the liquid developer;

a second connector member firmly fitted in an opening of said storage tank for closing the same and firmly receiving one end of a second supply pipe and one end of a second retrieval pipe which correspond to said first supply pipe and said first retrieval pipe, respectively;

means for moving said storage tank in a direction to bring said first connector member and said second connector member into pressure contact with each other so as to fluid-tightly connect together said first and second supply pipes and said first and second retrieval pipes, wherein said moving means comprises a mechanism operatively connected with a pivot door adapted to be opened and closed for replacing said storage tank and operative in response to pivotal movement of said pivot door.

2. A liquid developing device for electrostatic recording using a liquid developer, comprising:

a first connector member firmly receiving one end of a first supply pipe for supplying a liquid developer to a developing unit, and one end of a first retrieval pipe for returning the liquid developer from the developing unit, and one end of a first replenisher pipe for replenishing a concentrating agent;

a first storage tank for containing the liquid developer;

a second storage tank for containing the concentrating agent a second connector member firmly fitted in an opening of said storage tank for closing the same and firmly receiving one end of a second supply pipe and one end of a second retrieval pipe which correspond to said first supply pipe and said first retrieval pipe, respectively;

a third connector member firmly fitted in an opening of said second storage tank for closing the same and firmly receiving one end of a second replenisher pipe which corresponds to said first replenisher pipe; and means for moving said first and second storage tanks in a direction to bring said first connector member and said second connector member and said first connector member and said third connector member, respectively, into pressure contact with each other so as to fluid-tightly connect together said first and second supply pipes, said first and second retrieval pipes, and said first and second replenisher pipes, wherein said moving means comprises a mechanism operatively connected with a pivot door adapted to be opened and closed for replacing said storage tank and operative in response to pivotal movement of said pivot door.

3. A liquid developing device for electrostatic recording using a liquid developer, comprising:

a unitary storage tank having a first chamber for containing a liquid and a second chamber for containing a concentrating agent;

a first connector member firmly receiving one end of a first supply pipe for supplying the liquid developer to a developing unit, one end of a first retrieval pipe for returning the liquid developer from the developing unit, and one end of a first replenisher pipe for replenishing the concentrating agent, with said one ends of said first supply pipe, first retrieval pipe and first replenisher pipe lying in a common plane;

a second connector member firmly fitted in an opening of said first chamber for closing the same and firmly receiving one end of a second supply pipe and one end of a second retrieval pipe which correspond to said first supply pipe and said first retrieval, respectively;

a third connector member firmly fitted in an opening of said second chamber for closing the same and firmly receiving one end of a second replenisher pipe which corresponds to said first replenisher pipe, said one end of said second replenisher pipe lying in a common plane with said one ends of said second supply pipe and a second retrieval pipe; and means for moving said unitary storage tank in a direction to simultaneously bring said first connector member and said second connector member, respectively, into pressure contact with each other so as to fluid-tightly connect together said first and second supply pipes, said first and second retrieval pipes, and said first and second replenisher pipes.

4. A liquid developing device according to claim 3, wherein said second chamber is tapered downwardly and has a varying cross-sectional area progressively reducing in a direction from the top toward the bottom of said second chamber.

5. A liquid developing device according to claim 3, wherein said storage tank has a recess formed in an upper surface of said storage tank for receiving a drop of the liquid developer or a drop of the concentrating agent.

6. A liquid developing device according to claim 3, wherein said moving means comprises a mechanism operatively connected with a pivot door adapted to be opened and closed for replacing said storage tank and operative in response to pivotal movement of said pivot door.

7. A liquid developing device according to claim 2, wherein said first storage tank and said second storage tank are integrally formed into a single storage tank.

8. A liquid developing device according to claim 7, wherein said second storage tank is tapered downwardly and has a varying cross-sectional area progressively reducing in a direction from the top toward the bottom of said second storage tank.

9. A liquid developing device according to claim 7, wherein said single storage tank has a recess formed in an upper surface thereof for receiving a drop of the liquid developer or a drop of the concentrating agent.

* * * * *